US008308523B2

(12) United States Patent
Raymond

(10) Patent No.: US 8,308,523 B2
(45) Date of Patent: Nov. 13, 2012

(54) SWIMMING HOOP WITH ADJUSTABLE BUOYANCY MEMBER

(75) Inventor: Timothy J. Raymond, West Chicago, IL (US)

(73) Assignee: Water Sports, LLC, Plano, IL (US)

( * ) Notice: Subject to any disclaimer, the term of this patent is extended or adjusted under 35 U.S.C. 154(b) by 152 days.

(21) Appl. No.: 12/793,154

(22) Filed: Jun. 3, 2010

(65) Prior Publication Data

US 2011/0300956 A1 Dec. 8, 2011

(51) Int. Cl.
*A63H 23/10* (2006.01)
*A63H 3/06* (2006.01)

(52) U.S. Cl. ..... 446/153; 446/224; 434/254; 473/593

(58) Field of Classification Search ..... 446/220–226, 446/153–155; 472/13, 128, 129; 473/593; 273/350

See application file for complete search history.

(56) References Cited

U.S. PATENT DOCUMENTS

| | | | | |
|---|---|---|---|---|
| 3,014,723 | A | 12/1961 | Butler | |
| 3,095,197 | A * | 6/1963 | Weitzman | 273/350 |
| 3,323,795 | A * | 6/1967 | Quello | 472/128 |
| 3,332,166 | A | 7/1967 | Alexander | |
| 5,141,440 | A | 8/1992 | Wallingford | |
| 5,141,441 | A * | 8/1992 | Wallingford | 434/254 |
| 5,238,244 | A * | 8/1993 | Cotter et al. | 473/593 |
| 6,485,344 | B2 * | 11/2002 | Arias | 441/131 |
| 6,923,706 | B1 * | 8/2005 | Arias | 446/153 |
| 7,247,077 | B1 | 7/2007 | Arias | |

* cited by examiner

*Primary Examiner* — Kien Nguyen
(74) *Attorney, Agent, or Firm* — Erickson Law Group, PC

(57) ABSTRACT

A swimming hoop with a buoyancy member and flexible frame. By increasing or decreasing the buoyant force provided to the flexible frame by the buoyancy member, the user is able to position the swimming hoop at a desired vertical distance within a body of water. To increase or decrease the buoyant force, a pump is used to increase or decrease the level of air within an air chamber. The buoyancy member is adjustably secured to the flexible frame. The flexible frame may be generally circular, square, or any other shape, and is flexible such that other shapes can be further obtained by twisting or manipulating the flexible frame.

18 Claims, 7 Drawing Sheets

SWIMMING HOOP WITH ADJUSTABLE BUOYANCY MEMBER

FIELD OF THE INVENTION

This invention relates to the field of aquatic obstacles or amusement device.

BACKGROUND OF THE INVENTION

Aquatic obstacles or toys are available for use as amusement devices in a body of water. Such toys include targets or obstacles situated within the body of water, usually near the top surface of the body of water, or resting on the bottom surface of the body or water, with which a user interacts. A user may aim for the target and swim through the target, or avoid the target if the target is an obstacle.

The present inventor has recognized the need for an aquatic toy with variable buoyancy.

The present inventor has recognized the need for a versatile aquatic toy with an adjustable vertical position within a body of water.

The present inventor has recognized the need for an aquatic toy with adjustable size and configuration.

The present inventor has recognized the need for an aquatic toy with an adjustable orientation.

SUMMARY OF THE INVENTION

A swimming hoop with a buoyancy member and a flexible frame is disclosed. In one embodiment, the swimming ring comprises a buoyancy member attached to a flexible frame of the swimming hoop. The buoyancy member comprises an inflatable member, a pumping mechanism for filling the inflatable member, and an attachment mechanism. The inflatable member can be filled with air. The degree of buoyant force provided by the buoyancy member can be adjusted by altering the amount of air in the inflatable member.

In one embodiment, the buoyancy member may comprise an inflatable member and a decorative image. The buoyancy member is preferably made from a waterproof or water resistant material. The buoyancy member is adjustable in position along the flexible frame. The flexible frame has a generally circular shape.

In one embodiment the flexible frame is made from a flexible, resilient, metal or metallic material enclosed within a sheathing. The sheathing is preferably waterproof, and can be made of plastic, or other waterproof or water resistant material. The waterproof sheathing is preferably flexible and resilient such that it allows the flexible frame to conform to other shapes and also conforms along with the flexible frame into various shapes.

The flexible frame may be twisted or otherwise contorted into various shapes to provide greater amusement and variety for users.

Numerous other advantages and features of the present invention will be become readily apparent from the following detailed description of the invention and the embodiments thereof, from the claims and from the accompanying drawings.

BRIEF DESCRIPTION OF THE DRAWINGS

FIG. 3 illustrates the back side of the inflatable member.

DETAILED DESCRIPTION OF THE PREFERRED EMBODIMENTS

Figure 1:
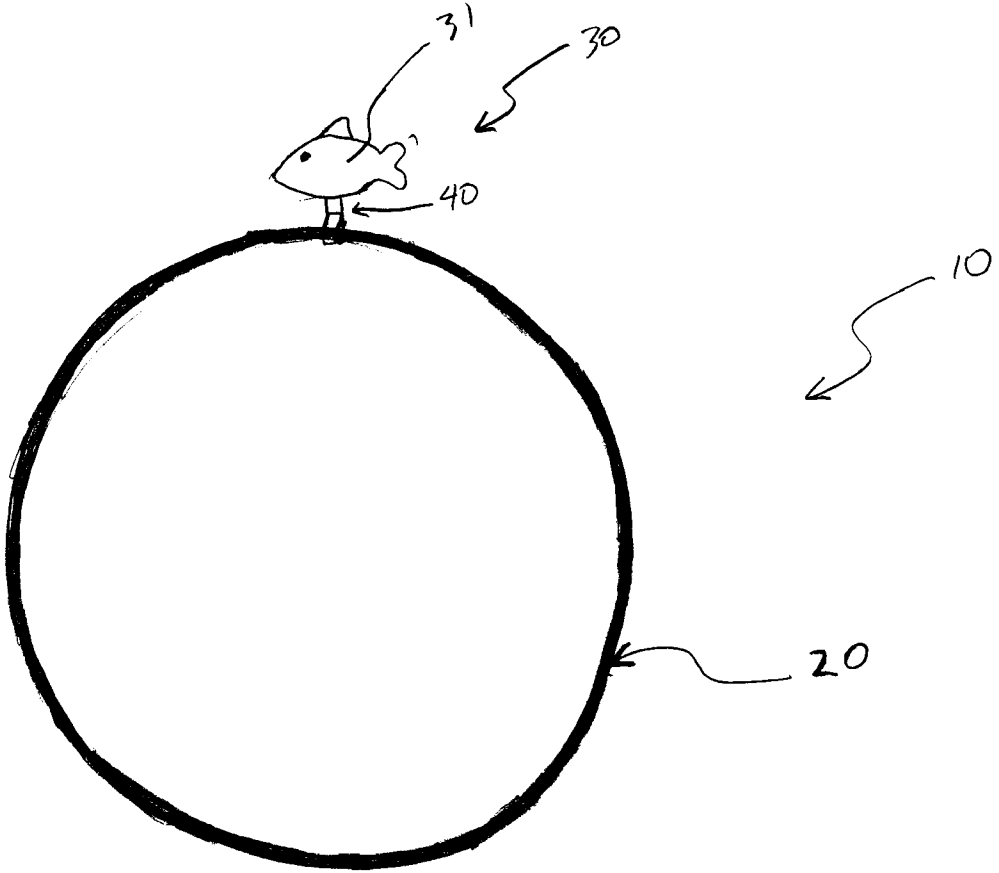
FIG. 1 illustrates a front view of an exemplary embodiment of the swimming hoop.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates an exemplary embodiment of the swimming hoop 10. The swimming hoop comprises a buoyancy member 30 and a flexible frame 20. The buoyancy member 30 is attached to the swimming hoop 10. The buoyancy member 30 can be attached via an attachment mechanism 40, such as a Velcro strap or a snap button on a strap, such that the position of the buoyancy member 30 is movable along the flexible frame 20. The flexible frame is generally circular. In one embodiment, the flexible frame is square shaped. The buoyancy member may be moved into positions such that the hoop provides a square or diamond shaped area through which a user may swim. By adjusting the position of the buoyancy member along the frame, the hoop may be oriented into a square or diamond shape as desired by the user. In other embodiments, the flexible frame may be other shapes such as an ellipse, a star, an animal shape, or any other shape.

The buoyancy member 30 further comprises a decorative image 31 and an inflatable member 35. The decorative image 31 may be a shape, and/or figure, such as a fish or a starfish, or other aquatic creature, other animal, or any other decorative image. The decorative image is attached to a front side 32 (FIG. 2) of the inflatable member 35. The decorative image 31 may be attached to the front side 32 using an adhesive, VELCRO hook and loop material, snap button, or other attachment methods. Alternatively, the decorative image may also be directly imprinted onto the inflatable member 35. The decorative image 31 is preferably be made of a waterproof or water resistant material such as, for example, plastic or foam.

Figure 2:
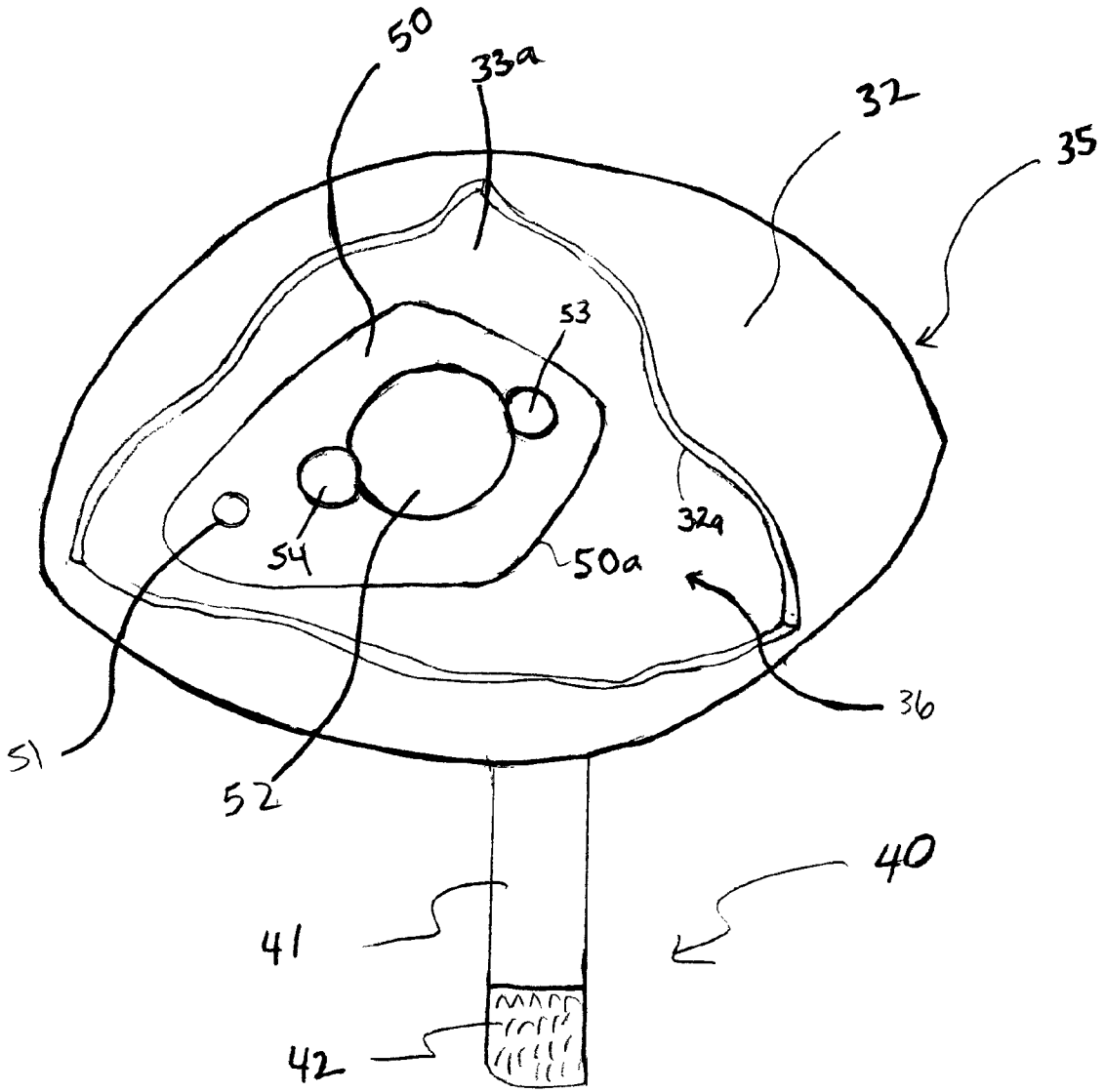
FIG. 2 illustrates the inflatable member with a portion of the front side of the inflatable member removed for clarity.
Figure 2:
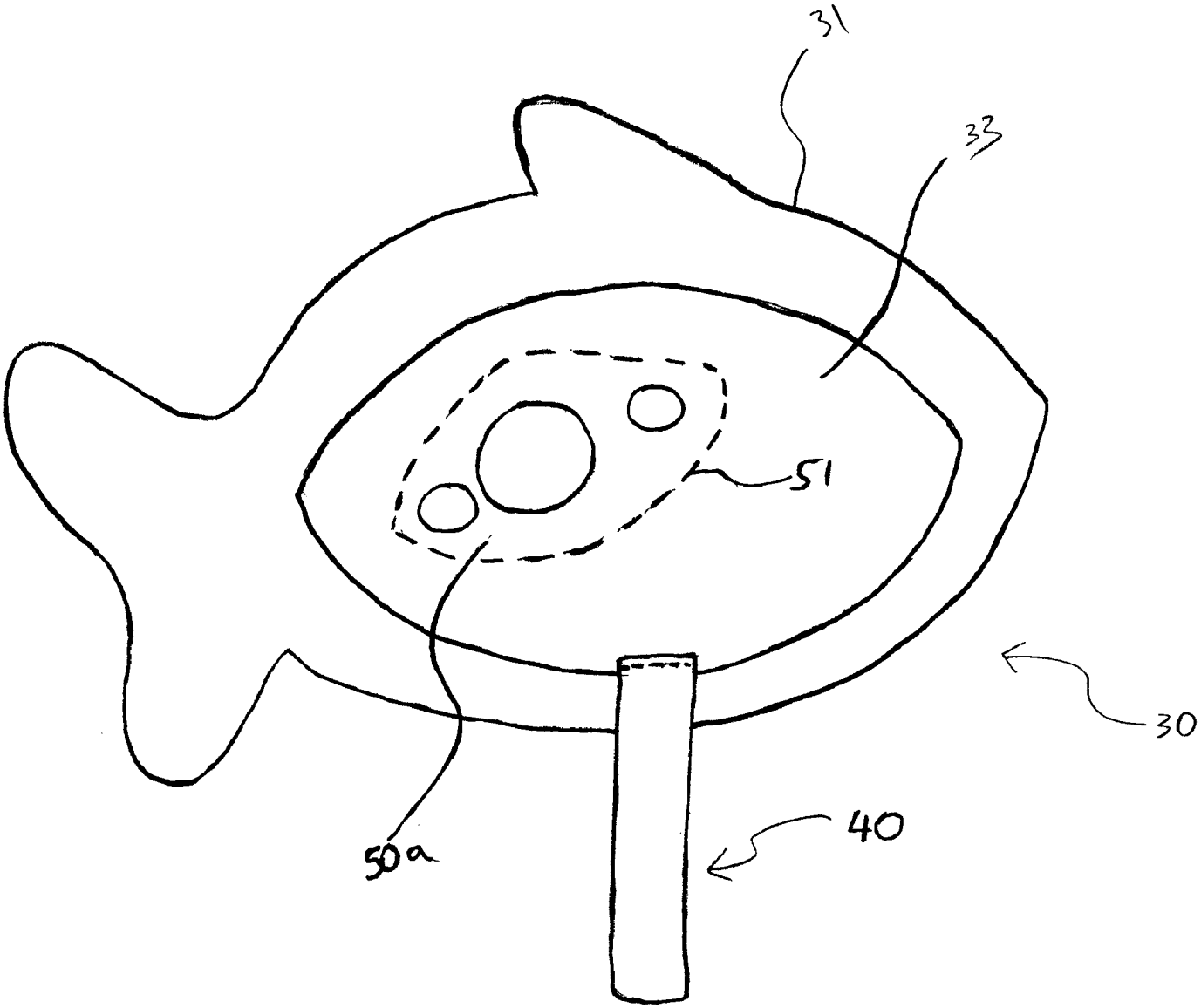

In the embodiment illustrated in FIG. 2, the inflatable member 35 comprises of an interior air chamber 36 formed within the enclosure defined by the front side 32 and back side 33 (FIG. 3) of the inflatable member. The front side 32 and back side 33 of the inflatable member can be made of fabric lined with a fluid impermeable coating such as a coating of polyethylene, or other water resistant or water proof material. The front side 32 and back side 33 are aligned such that the coated surfaces 32*a*, 33*a*, face each other to form a fluid impermeable air chamber 36. The coated surfaces 32*a*, 33*a* are sealed against each other at the edges to form the air chamber 36. Alternatively, the inflatable member can be a rubber bladder, or the like. The inflatable member itself may be shaped decoratively.

To increase or decrease the air level within the air chamber 36 of the inflatable member 35, a pumping mechanism 50 is used. Pumping mechanism 50 is disposed within the air chamber 36 and is used to introduce air into the air chamber 36 through the use of an inlet valve 53, a resiliently collapsible bulb or air bubble 52, an outlet valve 54, and a deflating valve 51. The pumping mechanism 50 is attached to an interior coated surface of the air chamber. As illustrated, the pumping mechanism is on the back side 33 of the air chamber, on coated surface 33*a*. The deflating valve 51 and the inlet valve 53 are in communication with the exterior of the air chamber 36. To introduce air into the air chamber 36, the air bubble 52 is depressed or squeezed to force the air in the air bubble 52 into the air chamber 36 via the outlet valve 54. The air bubble 52 is filled by air entering the air bubble 52 via the inlet valve 53. The inlet valve 53 and the outlet valve 54 are one way valves. The inlet valve 53 prevents air from exiting from the inlet valve 53 when the air bubble 52 is pressed, such that the air displaced in the air bubble 52 enters the outlet valve 54 to fill the air chamber 36. The one way nature of the outlet valve 54 only allows air to enter the air chamber 36 from the air bubble 52, and prevents air from exiting the air chamber 36. Other suitable pumping mechanisms known to one skilled in the art can also be used.

As the user pumps air into the air chamber 36, the air chamber gradually fills with air. To decrease the amount of air in the air chamber 36, the user presses on the deflating valve 51, to open the deflating valve which releases the air from the air chamber 36 to the outside. The deflating valve is a one way valve which is normally closed by pressure within the chamber 36. Using the air pump, the user is able to adjust the amount of air in the air chamber 36 to a desired level, thus adjusting the buoyant force exerted on the hoop.

An attachment mechanism 40 is connected to the inflatable member 35. As illustrated in FIG. 2, the attachment mechanism is a VELCRO hook and loop fastener strap attached to the air chamber. Sections 41 and 42 of the VELCRO strap are complementary surfaces which allow the strap to engage with itself when wrapped around the flexible frame. The VELCRO strap is attached to the inflatable member by sewing the VELCRO strap to the sealed edges of the inflatable member 35, so as not to puncture any portion of the air chamber 36.

FIG. 3 illustrates the back side 33 of the air chamber. The decorative image 31 is attached on the opposite surface so as not to interference with the valves of the pumping mechanism 50. As illustrated in FIG. 3, the outline 50*a* of the pumping mechanism 50 attached to the inner surface of the back side 33*a* is visible from the back side 33 because the pumping mechanism 50 is attached to the inner surface of the back side 33*a* by sealing the perimeter 50*a* of the pumping mechanism 50 against the inner surface of the back side.

The pumping mechanism 50 can be made from rubber, silicone, or other suitable material with adequate gas impermeability to prevent gas in the air chamber from leaking. The pumping mechanism 50 can be heat sealed to the inner surface of the back side 33*a*, wherein the gas impermeable coating and the perimeter of the pumping mechanism can be heated to adhere to each other. Other methods of attaching the pumping mechanism known to one skilled in the art can also be used.

Figure 4:
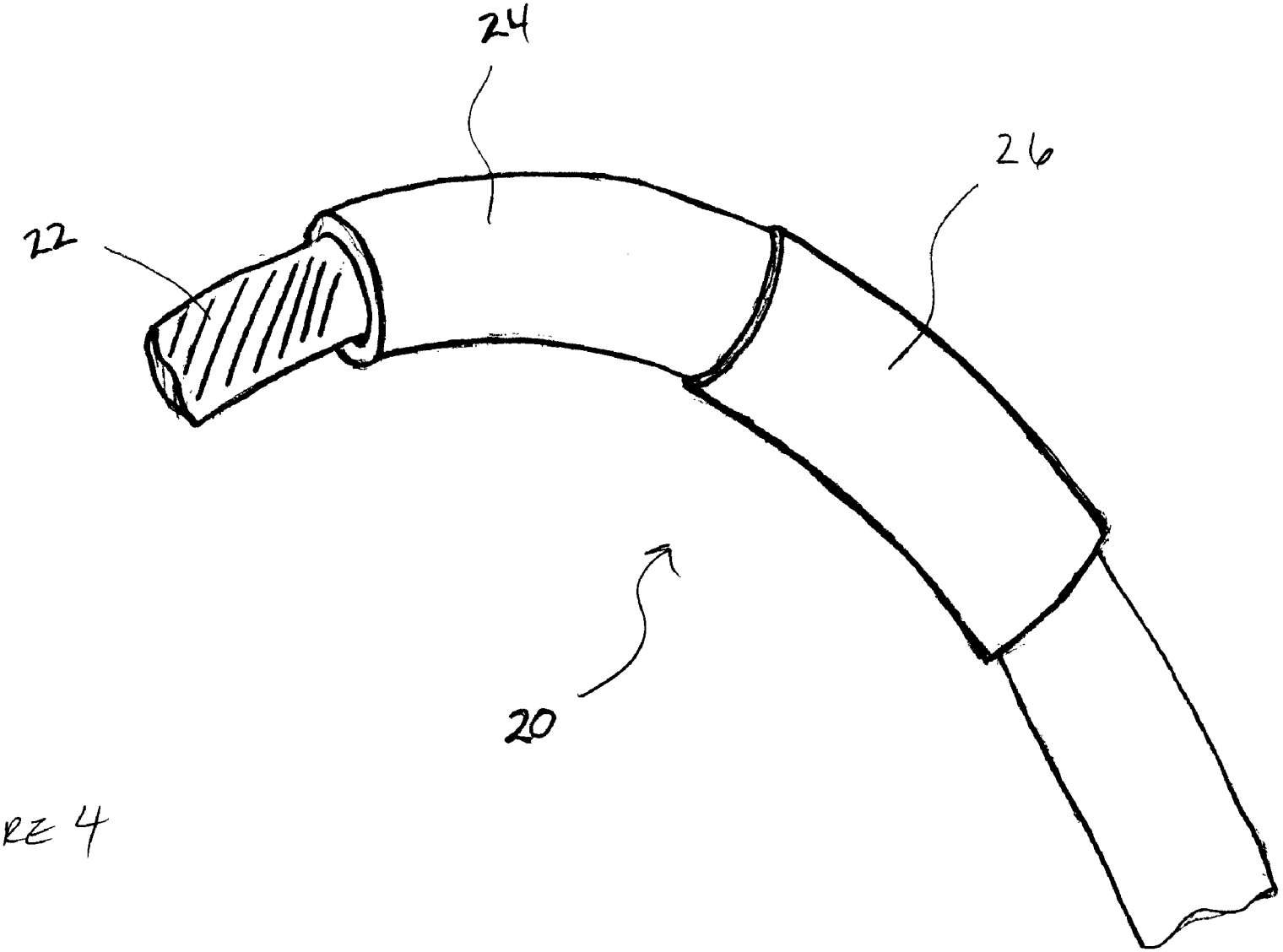
FIG. 4 illustrates the layers of the swimming hoop

FIG. 4 illustrates the flexible frame 20 of the swimming hoop. In one embodiment, the flexible frame 20 comprises a metal ring 22, a sheath or covering 24, and a connector segment 26. The metal ring 22 is disposed within a sheath or covering 24, which protects the metal ring from corrosion and provides a more user friendly feel. The open ends of the metal ring 22 and the sheath are connected to each other within the connector segment 26. The ends of the metal ring 22 may be welded together, or connected by other suitable mechanisms. The sheath or covering may be held in position within the connector segment 24 through frictional force, an adhesive mechanism such as glue, or any other suitable mechanism. In other embodiments the flexible frame may be rigid.

Alternatively, the flexible frame 20 can be made of other materials such as rubber, silicone, polyethylene, polyvinylchloride, or other suitable polymeric material. The material may have a density greater than the density of water, such that the flexible frame would sink in a body of water. The flexible frame 20 is then prevented from sinking by the buoyant force exerted on the flexible frame 20 by the buoyancy member 30.

Figure 5B:
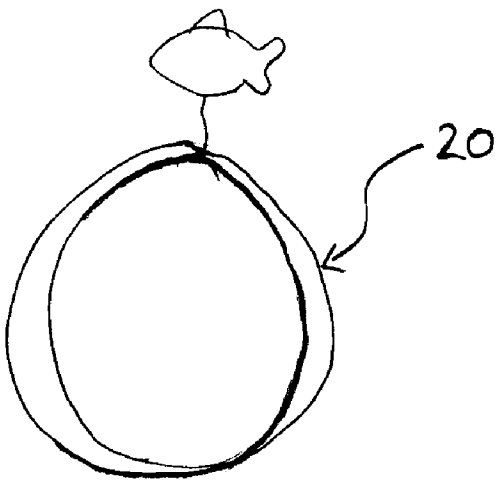
FIG. 5B illustrates another configuration of the swimming hoop.
Figure 5A:
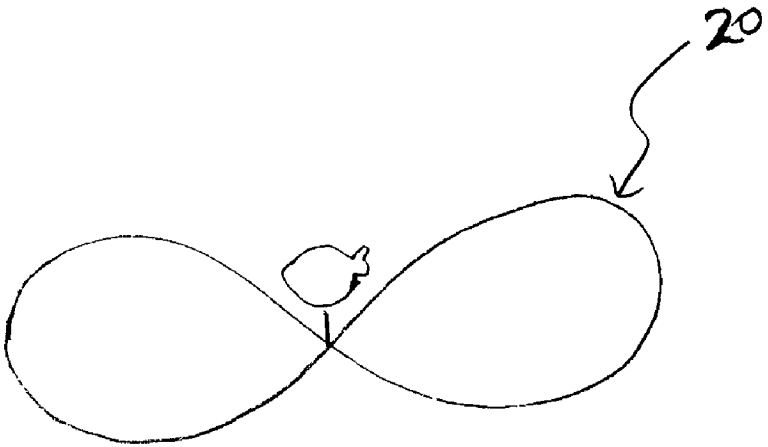
FIG. 5A illustrates one configuration of the swimming hoop.
Figure 6:
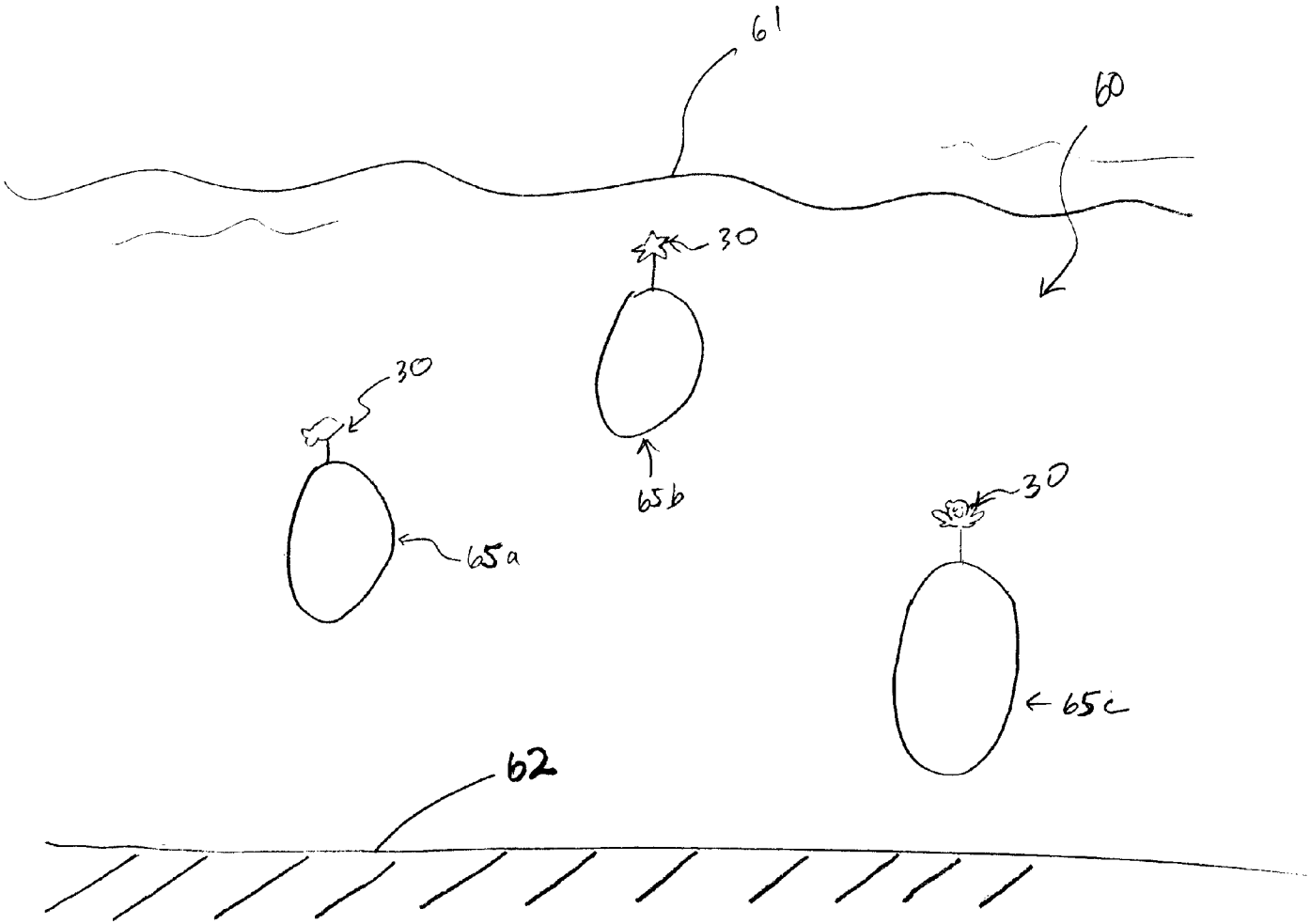
FIG. 6 illustrates one exemplary embodiment of the swimming hoop in use.
Figure 7:
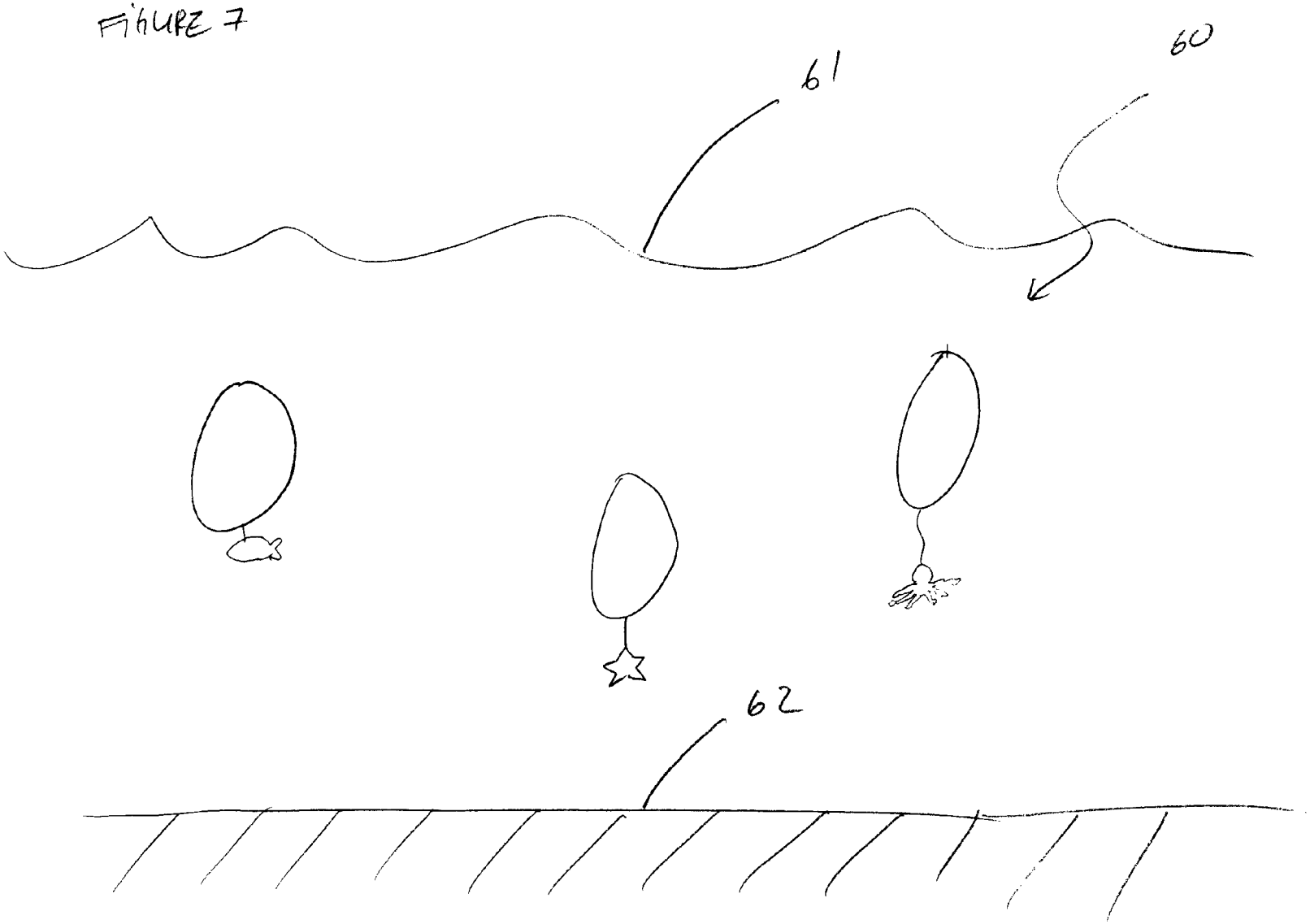
FIG. 7 illustrates another embodiment of the swimming hoop in use.

FIG. 6 illustrates one embodiment of the swimming hoop in use. The swimming hoop is placed in a body of water and used as targets through which users swim. The vertical location of the swimming hoop, as determined by the distance between a part of the hoop to the bottom surface 62 or top surface 61 of the body of water 60, can be adjusted by varying the amount of air within the buoyancy member 30. Thus, several swimming hoops 65*a*, 65*b*, 65*c* can be used to set up a underwater obstacle course with swimming hoops 65*a*, 65*b*, and 65*c* at various depths through which a user must swim. Due to the flexible nature of the swimming hoop, it is possible to rearrange the swimming hoop 20 into other configurations as illustrated in FIG. 5A, or 5B to provide for more variety. The flexible frame can be conditioned to return into its original configuration if not secured to be a particular configuration, or the flexible frame may be made of material that will allow the flexible frame to stay in a particular configuration.

In another embodiment, the flexible frame may be made of material(s) that have a density less than the density of water, such that the flexible frame would float in the body of water. The vertical position of the swimming hoop in a body of water would be adjusted by a buoyancy member for which the addition or removal of weights would alter the vertical position of the swimming hoop.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A swimming hoop for use in a body of water comprising:
a frame forming an opening of a sufficient size for a swimmer to swim through;
a buoyancy member attached to the frame, the buoyancy member comprises a pump and an inflatable air chamber; the pump operatively connected to the inflatable air chamber and operable to inflate the air chamber; the air chamber having a release valve in communication with the air chamber and operable to user selectively release air from the air chamber.

2. The swimming hoop of claim 1, wherein the buoyancy member comprises an attachment mechanism that releasably attaches the buoyancy member to the frame, the attachment mechanism is user positionable at a plurality of locations along a length of the frame.

3. The swimming hoop of claim 1, wherein the pump is disposed within the inflatable air chamber.

4. The swimming hoop of claim 1, wherein the buoyancy member comprises at least one weighted member.

5. The swimming hoop of claim 4, wherein the at least one weighted member is removable from the buoyancy member.

6. The swimming hoop of claim 1, wherein the pump is adjacent to the release valve.

7. The swimming hoop of claim 1, comprising a flexible strap that connects the buoyancy member to the frame.

8. The swimming hoop of claim 1, wherein the frame has a flexibility sufficient to allow a user to fold the frame from a single large loop position over on itself to form a double loop position.

9. The swimming hoop of claim 8, wherein the frame has a resilience sufficient restore the hoop frame to the single large loop position when not secured in the double loop position.

10. A method of positioning a swimming hoop at a desired vertical position within a body of water comprising the steps of:

providing a variable buoyant force to the hoop with an attached inflatable buoyancy member, the inflatable buoyancy member comprising a pump for inflating the buoyancy member;

adjusting the buoyant force with the pump until the hoop generally maintains a desired vertical position within a body of water.

11. The method of claim 10, wherein the step of providing a variable buoyant force on the hoop comprises the step of increasing an amount of air within the inflatable buoyancy member.

12. The method of claim 10, wherein the step of adjusting the buoyant force comprises the step of decreasing an amount of air within the inflatable buoyancy member by a release valve in communication with the inflatable buoyancy member.

13. The method of claim 10 wherein the step of adjusting the buoyant force comprises the step of decreasing or increasing an amount of air within inflatable buoyancy member.

14. The method of claim 10, further comprising the step of adjusting the buoyant force by decreasing or increasing an amount of weight on the hoop until the hoop generally maintains a desired vertical position within the body of water.

15. A swimming hoop for use in a body of water comprising:

a hoop frame having a flexibility sufficient to allow a user to fold the hoop frame from a single large loop position over on itself to form a double loop position; and an inflatable buoyancy member attached to the frame, the inflatable buoyancy member comprises a pump and an inflatable air chamber, the pump operatively connected to the air chamber and operable to inflate the air chamber, the air chamber having a release valve in communication with the air chamber and operable to user selectively release air from the air chamber.

16. The swimming hoop of claim 15, wherein the pump is adjacent to the release valve.

17. The swimming hoop of claim 15, wherein the frame has a resilience sufficient restore the hoop frame to the large loop position when not secured in the double loop position.

18. The swimming hoop of claim 15, comprising a flexible strap that releasably connects the buoyancy member to the frame; and, wherein the buoyancy member is user positionable at a plurality of locations along a length of the frame.

* * * * *